US008590477B2

(12) United States Patent
Leonard

(10) Patent No.: US 8,590,477 B2
(45) Date of Patent: Nov. 26, 2013

(54) COLLAPSIBLE AMPHIBIOUS HUNTING BLIND

(76) Inventor: Shane A. Leonard, Reading, PA (US)

( * ) Notice: Subject to any disclaimer, the term of this patent is extended or adjusted under 35 U.S.C. 154(b) by 395 days.

(21) Appl. No.: 12/948,940

(22) Filed: Nov. 18, 2010

(65) Prior Publication Data

US 2012/0125251 A1 May 24, 2012

(51) Int. Cl.
*B63B 7/00* (2006.01)

(52) U.S. Cl.
USPC ..... 114/351; 114/361; 114/345

(58) Field of Classification Search
USPC ..... 114/344, 351, 347, 345, 363, 361
See application file for complete search history.

(56) References Cited

U.S. PATENT DOCUMENTS 1,555,080 A * 9/1925 Scheibert ..... 114/345
3,394,417 A * 7/1968 O'Link ..... 114/363
3,566,425 A * 3/1971 Welty ..... 114/345
3,659,298 A * 5/1972 Edwards ..... 114/345
4,480,578 A * 11/1984 Fisher et al. ..... 114/344
4,825,799 A 5/1989 Bergeron et al.
5,070,807 A * 12/1991 Lewis ..... 114/361
5,474,481 A 12/1995 Ramsey
5,564,357 A * 10/1996 Peterson ..... 114/345
D392,935 S 3/1998 Cripe
5,730,080 A 3/1998 Cripe
5,887,539 A 3/1999 Rex et al.
6,257,470 B1 7/2001 Schaefer
6,623,322 B1 * 9/2003 Lesniak ..... 441/38
6,769,379 B2 8/2004 Foiles

* cited by examiner

*Primary Examiner* — Edwin Swinehart
(74) *Attorney, Agent, or Firm* — Montgomery Patent & Design; Robert C. Montgomery

(57) ABSTRACT

A collapsible amphibious hunting blind includes an inflatable camouflaged bladder including a waterproof floor and an upper mesh canopy structure to stealthily conceal a user inside during a water fowl hunting or observing activity. The inflatable blind provides an inner space capable of containing a slightly reclined and seated user being positioned between raised side wall portions allowing a user to float on a body of water. The blind includes an air pump for inflating the blind prior to use. The blind further includes a pair of wheels along a bottom surface for transportation across a ground surface when in an inflated state and also includes a carrying bag for transporting in a deflated and folded state.

18 Claims, 10 Drawing Sheets

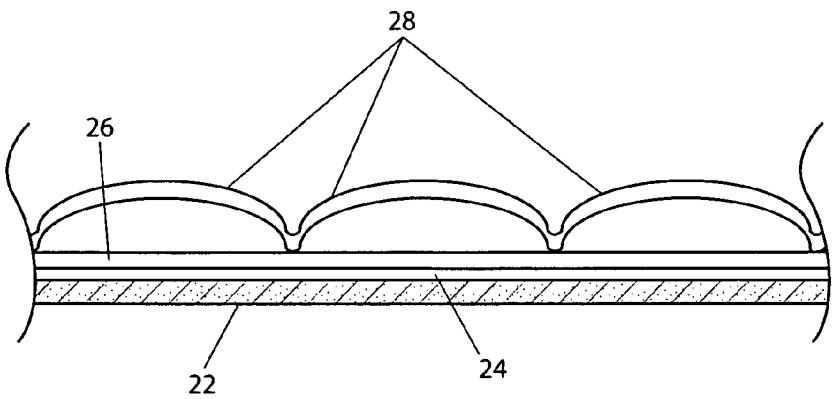
Fig. 4
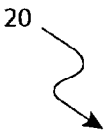

COLLAPSIBLE AMPHIBIOUS HUNTING BLIND

FIELD OF THE INVENTION

The present invention relates generally to blinds used for hunting, and in particular, to a collapsible amphibious hunting blind for hunting waterfowl.

BACKGROUND OF THE INVENTION

Over the years, modern advances in hunting equipment have enhanced the sport, providing hunters with increased success. One (1) product that is available in many different shapes and sizes and used with all types of wild game and various weaponry is that of a hunting blind. Hunting blinds are available to sit on land, in trees, and even in water.

Hunters interested in hunting waterfowl, such as ducks, encounter particular disadvantages since in many instances waterfowl are only available in locations accessible by a boat or other floatation device. One (1) particular type of hunting blind, the layout hunting blind, is typically used to hunt waterfowl. However, most of these blinds are designed for use on land near areas waterfowl are known to pass over. In many cases, the hunter must use a boat in order to reach the desired location to set up these stationary, land based blinds. Additionally, these blinds are typically of a large nature that are not only difficult and slow to set up, but are also difficult to transport. In fact, when traveling by air to a favorite hunting spot, most hunters are forced to leave their layout hunting blinds at home.

There have been attempts to provide portable hunting blinds which are designed to be attached to or used with boats or other floatation devices. These types of blinds vary in complexity, the visual range offered to the hunter occupying the blind, and the adaptability for use with particular types of boats. However, none of these blinds offer satisfactory solutions to these various problems and each suffer from at least one (1) deficiency and disadvantage in design or utilization.

SUMMARY OF THE INVENTION

The inventor recognized the aforementioned inherent problems and lack in the art and observed that there is a need for a device and method which provides a hunter a portable and convenient way to track and hunt waterfowl. It is an object of the present disclosure to solve these problems.

The inventor recognized these problems and has addressed this need by developing of a collapsible amphibious hunting blind that offers a concealed floatable platform for the hunter to occupy, a wide and unobstructed range of view, and the ability for the hunter to fire in almost any direction quickly. The device also provides a hunting blind that was durable, cost effective, and simple to set up and use. Additionally, the blind is collapsible to provide for compact storage and ease of transport.

The inventor has thus realized the advantages and benefits of providing a buoyant inflatable bladder, a flexible floor panel extending between lower interior sidewalls of the bladder, and a flexible and durable bladder cover that completely surrounds the bladder. A rigid stern board is affixed to a stern end of an upper surface of the floor panel to support the mass of the occupant and a seat assembly. A rigid bow board is affixed to a bow end of the upper surface of the floor panel to support the lower portion and feet of the occupant. The seat assembly is pivotably connected to the stern board and provides support for an occupant in a generally supine position.

A canopy assembly is removably attached to the stern end of a top of the bladder for generally covering the stern end and concealing an upper portion of the occupant. A top cover is also releasably fastened between upper interior sidewalls of the bladder from the bow end to the stern end for generally covering the bow end and concealing the lower portion of the occupant. The blind also provides a plurality of flexible loops running along each side and front of the bladder attached to the bladder cover for the hunter to add additional camouflage material or tie off the blind for temporary anchoring. Using the blind, the occupant can easily and quickly transition from a reclined and concealed position to a generally upright and firing position. The blind is also foldable about a flexible area between the stern board and the bow board when the bladder is deflated for placing the blind in a collapsed state for storage and transport in a provided carrying bag.

Furthermore, the described features and advantages of the disclosure may be combined in various manners and embodiments as one skilled in the relevant art will recognize. The disclosure can be practiced without one (1) or more of the features and advantages described in a particular embodiment.

Further advantages of the present disclosure will become apparent from a consideration of the drawings and ensuing description.

BRIEF DESCRIPTION OF THE DRAWINGS

The advantages and features of the present disclosure will become better understood with reference to the following more detailed description and claims taken in conjunction with the accompanying drawings, in which like elements are identified with like symbols, and in which:

FIG. 4 is a section view of a wall portion of a flotation assembly 20 taken along section line A-A of FIG. 3*a*, according to the preferred embodiment;

DESCRIPTIVE KEY

Figure 1:
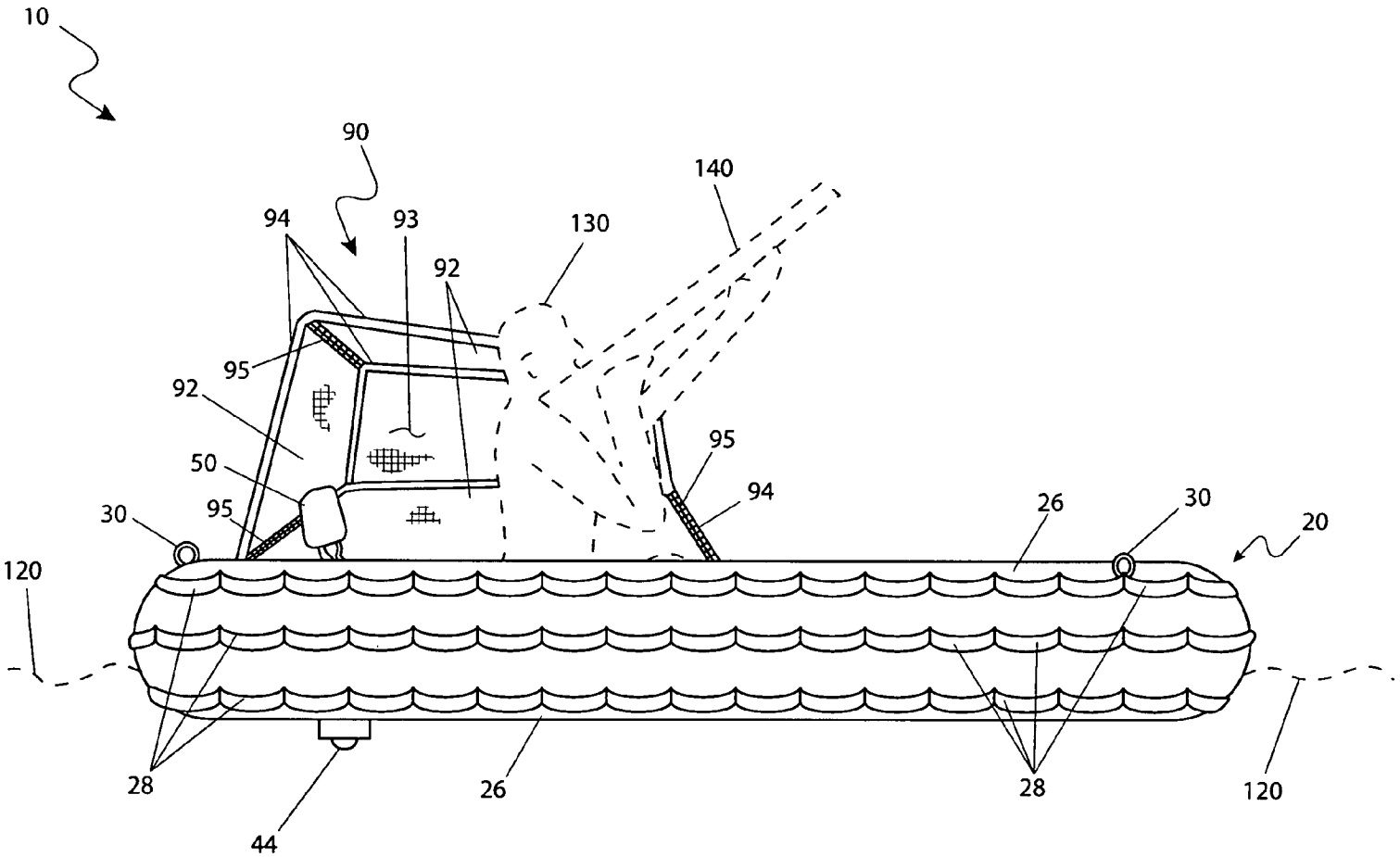
FIG. 1 is an environmental view of a collapsible amphibious hunting blind 10 depicting a shooting state, according to a preferred embodiment.

10 collapsible amphibious hunting blind
20 flotation assembly
22 bladder
24 adhesive layer
26 bladder cover
27 floor panel
28 loop
30 ring
32 rear panel
34 fill valve
40 seat assembly
42 stern board
44 wheel assembly
45 wheel axle
46 seat back
48 hammock
50 head rest
51 adjustable rod
52 first hammock connector
54 second hammock connector
56 guy wire
58 seat back latch
60 axle
70 bow board
80 top cover
82 first zipper
84 zipper puller
86 zipper stop
90 canopy assembly
92 mesh side panel
93 mesh roof panel
94 canopy frame
95 second zipper
96 canopy fastener
100 air pump
102 hose
103 hose adapter
104 ON/OFF switch
110 carrying bag
112 bag body
114 closure
115 cinch cord
116 locking fitting
117 handle
118 pouch
119 inner space
120 water
130 user
140 rifle

DETAILED DESCRIPTION OF THE PREFERRED EMBODIMENT

The best mode for carrying out the disclosure is presented in terms of a preferred embodiment, herein depicted within FIGS. 1 through 9. However, the disclosure is not limited to a single described embodiment and a person skilled in the art will appreciate that many other embodiments are possible without deviating from the basic concept of the disclosure and that any such work around will also fall under its scope. It is envisioned that other styles and configurations can be easily incorporated into the teachings of the present disclosure, and only one particular configuration may be shown and described for purposes of clarity and disclosure and not by way of limitation of scope.

The terms "a" and "an" herein do not denote a limitation of quantity, but rather denote the presence of at least one of the referenced items.

The present invention describes a collapsible amphibious hunting blind (herein described as an "apparatus") 10, which provides a personal hunting blind structure generally including an inflatable flotation assembly 20, a seat assembly 40, a top cover 80, a mesh canopy assembly 90, an air pump 100, and a carrying bag assembly 110. The apparatus 10 provides a floating enclosure having an inner space capable of containing a user 130 such that the user 130 can sit in a reclined position upon a fabric hammock 48 and float on a water surface 120. The apparatus 10 further includes a pair of wheels 44 along a lower surface for allowing the apparatus 10 to be wheeled across a ground surface when in an inflated state. The apparatus 10 also includes a zippered camouflage top cover 80 which covers an open top portion, effectively concealing the user 130 during an aquatic hunting or game observing activity. The apparatus 10 further includes a carrying bag 110 for ease of transportation in a deflated and folded state.

Figure 2:
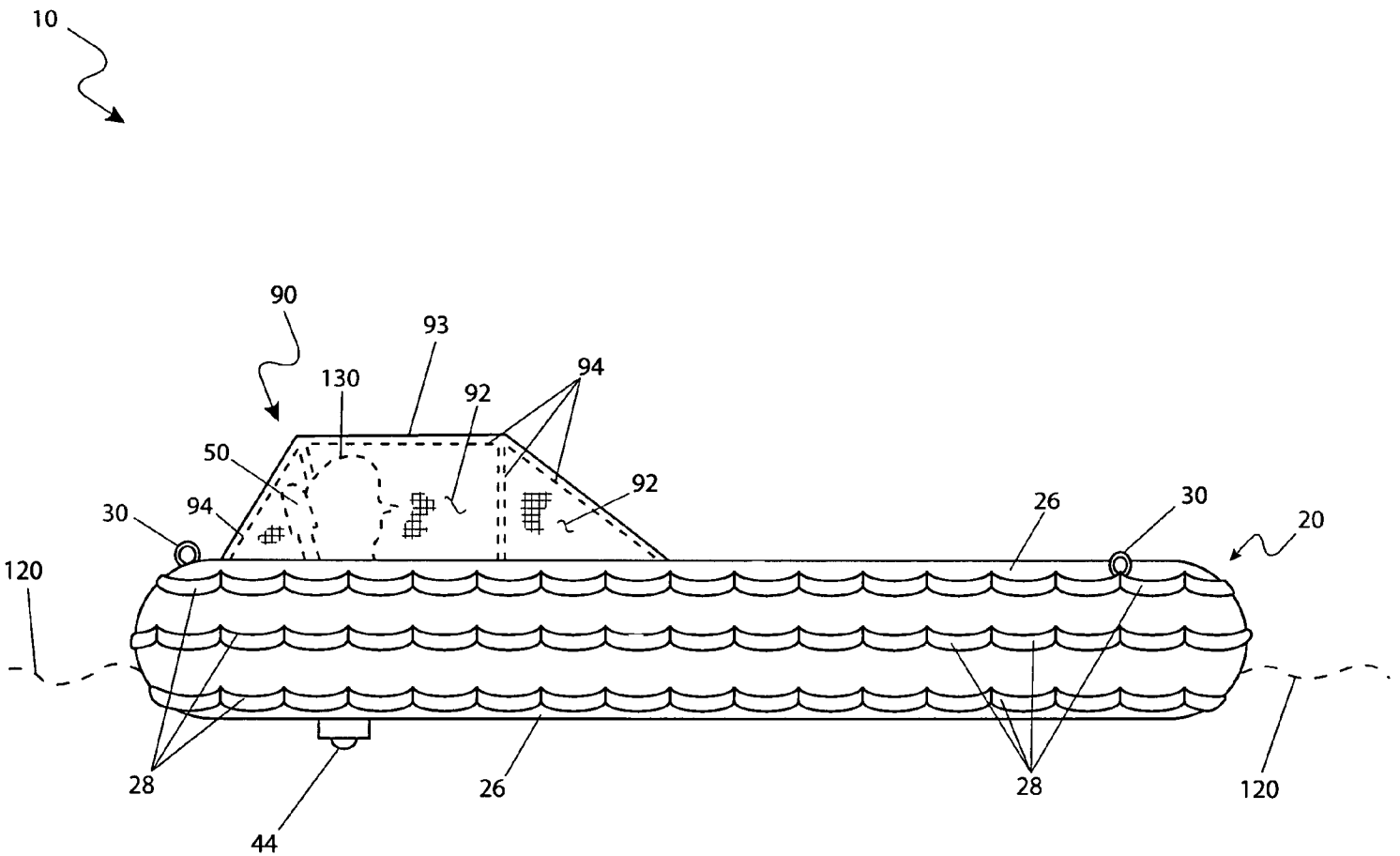
FIG. 2 is an environmental view of the collapsible amphibious hunting blind 10 depicting a ready state, according to the preferred embodiment.

Referring now to FIGS. 1 and 2, environmental views the apparatus 10 in a shooting state and a ready state, respectively, are disclosed. The apparatus 10 includes a one-person floating waterproof and sealed enclosure principally made of light-weight rubber and textile materials. The apparatus 10 provides for a user 130 to be discreetly concealed within the apparatus 10 in a reclined sitting position, leaning against the seat assembly 40. Furthermore, the user 130 is covered over by the mesh canopy assembly 90. Upon sighting game animals, such as waterfowl, the user 130 may quickly move the canopy assembly 90 to a side location; elevate him or herself to an upright sitting position within the apparatus 10; and, commence to shoot at the game using a rifle 140 or similar firearm. Furthermore, the apparatus 10 may be utilized to effectively observe the game animals and waterfowl in a stealth-like manner without detection.

The flotation assembly 20 includes a "U"-shaped rubber bladder 22 having a round cross-section approximately twelve (12) inches in diameter. The flotation assembly 20 further includes a waterproof and camouflaged bladder cover 26 which completely covers the bladder 22 and is securely and permanently bonded to the bladder 22 by a layer 24 of industrial marine adhesive, as shown in FIG. 4. The bladder cover 26 is envisioned to be fabricated to contain various compositions, laminations, and supplemental coatings or coverings along external surfaces of the bladder 22, which provide additional resistance to puncturing, abrasion, wear, and the like. The bladder cover 26 is preferably made from such materials as, but not limited to: impregnated and laminated fabric layers; fiberglass fibers, strips, or panels; KEVLAR® fibers, strips, or panels; or, equivalent protective materials and coverings. The bladder cover 26 further includes a plurality of loops 28 sewn thereto. The loops 28 are disposed along at least three (3) horizontal rows and are made of strong nylon or plastic strapping material which is intermittently sewn to outwardly-facing surfaces of the bladder cover 26 in an equally-spaced manner. The loops 28 are envisioned to be utilized to secure additional camouflage materials such as various natural or artificial foliage, branches, reeds, and the like, which can be inserted through the loops 28. Additionally, the loops 28 are utilized to mount a plurality of metal rings 30 preferably located at corner areas around the apparatus 10, in order for the user 130 to attach or anchor the apparatus 10 to an adjacent structure or appendage using rope, cord, or twine.

Figure 5:
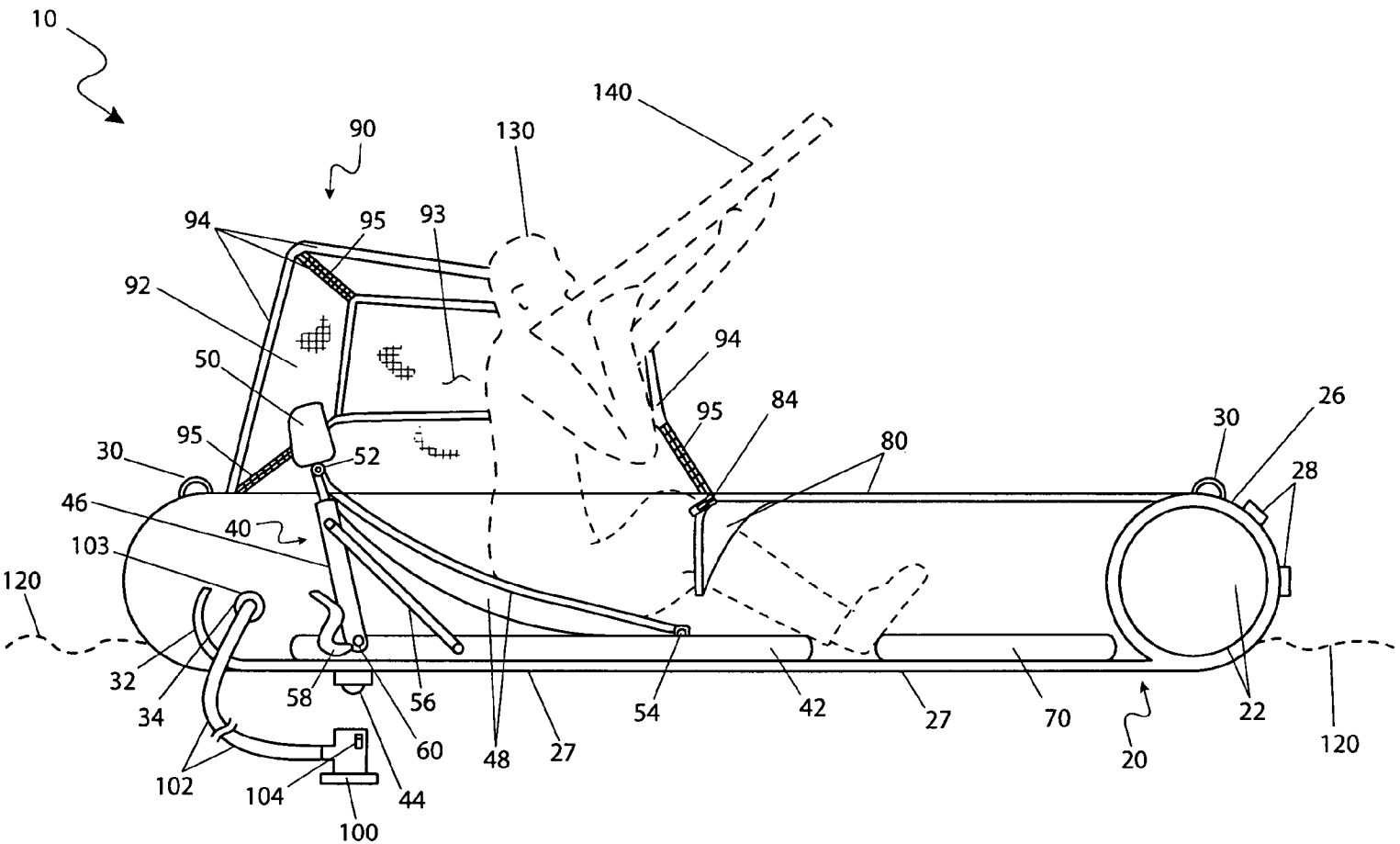
FIG. 5 is a transparent view of the collapsible amphibious hunting blind 10 depicting the in-use state, according to the preferred embodiment.

The bladder cover 26 includes a flat appendage which extends inwardly from inner lower surfaces of the flotation assembly 20 to form a sealed and waterproof horizontal floor panel 27. The floor panel 27 includes a vertical rear panel 32 which forms a vertical barrier across a rear open portion of the flotation assembly 20 to further prevent water 120 from entering the apparatus 10. The floor panel 27 provides for attachment and support to a rigid stern board 42 and bow board 70 which are permanently bonded to the floor panel 27 to support the user 130 and the seat assembly 40 as seen in FIGS. 3*a* and 5.

The flotation assembly 20 further provides for the attachment of a top cover 80 which provides a flat covering along a top surface, concealing the user 130 discreetly within the apparatus 10. The top cover 80 is affixed to an upper center surface of the flotation assembly 20 by a first zipper 82 which extends an entire length of a perimeter of the flotation assembly 20. The top cover 80 is envisioned being made using similar durable waterproof textile materials as the bladder cover 26.

The bladder cover 26, floor panel 27, rear panel 32, and top cover 80 are envisioned to be fabricated in a similar manner and material as whitewater rafts, being fabricated from either a unitary textile sheet or an assembly of cut sheets being joined together using textile processes such as sewing, adhesives, heat welding, and the like, so as to form a flexible waterproof barrier.

Figure 3A:
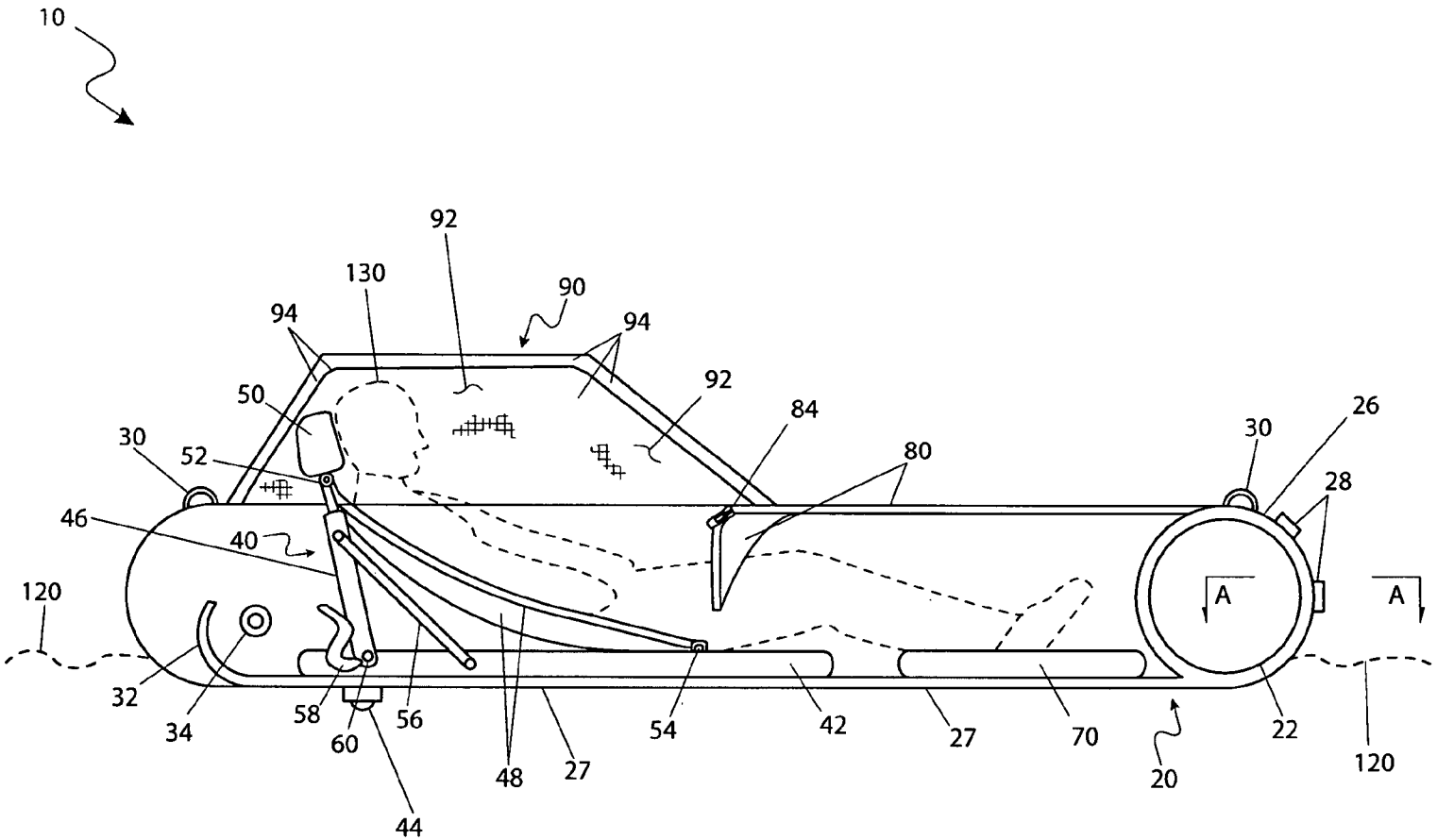
FIG. 3*a* is a transparent view of the collapsible amphibious hunting blind 10 depicting the ready state, according to the preferred embodiment.
Figure 3B:
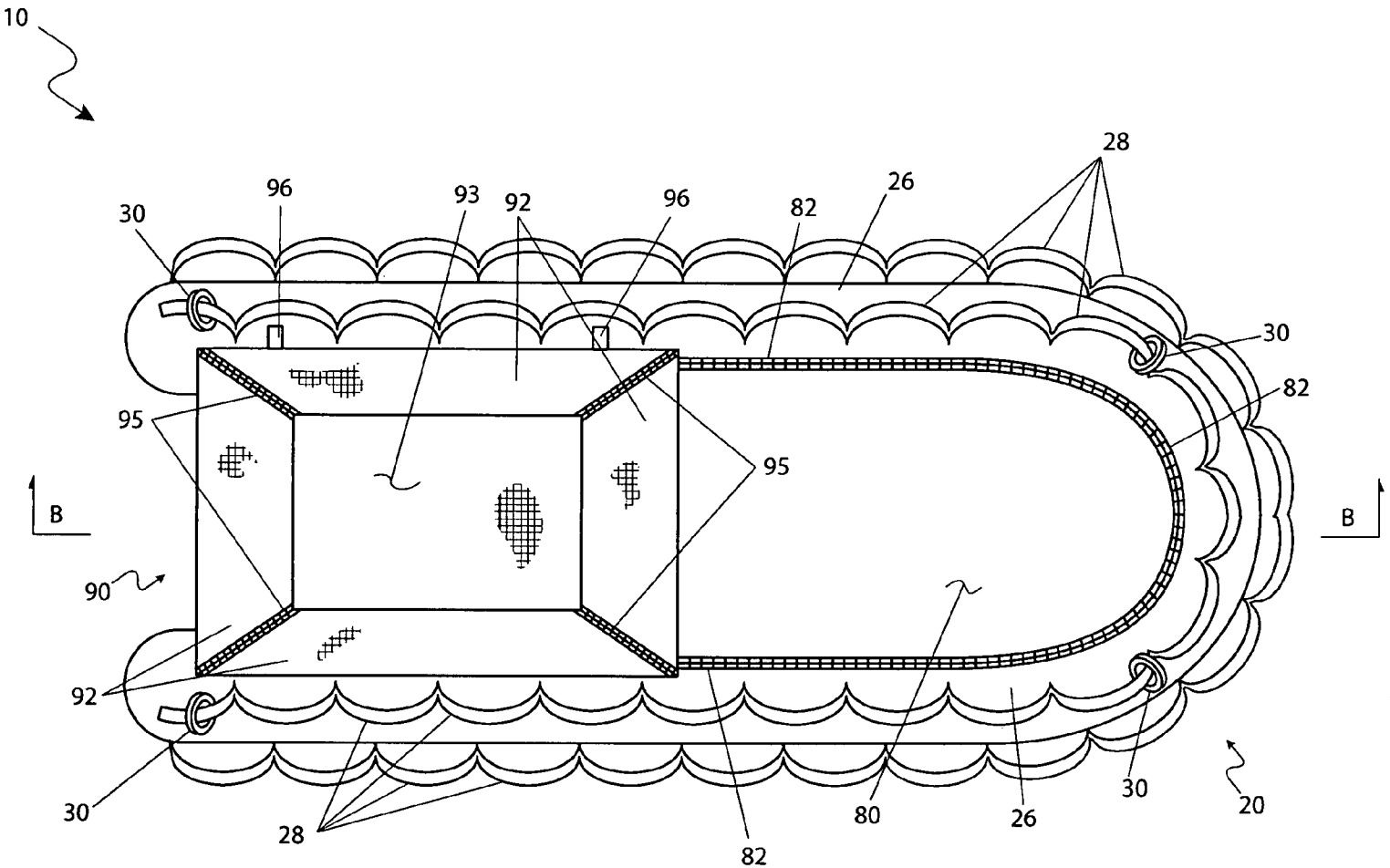
FIG. 3*b* is a top view of the collapsible amphibious hunting blind 10 depicting the ready state, according to the preferred embodiment.

Referring now to FIG. 3*a*, a transparent view of the apparatus 10; FIG. 3*b*, a top view of the apparatus 10 depicting the ready state; and FIG. 4, a section view of the flotation assembly 20, are disclosed. The seat assembly 40 works in conjunction with and provides for the attachment of the hammock 48, thereby providing a comfortable support for the user 130 complete with a head rest 50, which comfortably allows the user 130 to occupy the apparatus 10 for extended periods of time. The hammock 48 includes a rugged textile body-length panel made using comfortable breathable materials such as, but not limited to, canvas, various fabrics, and the like fabricated using textile assembly techniques.

Figure 7:
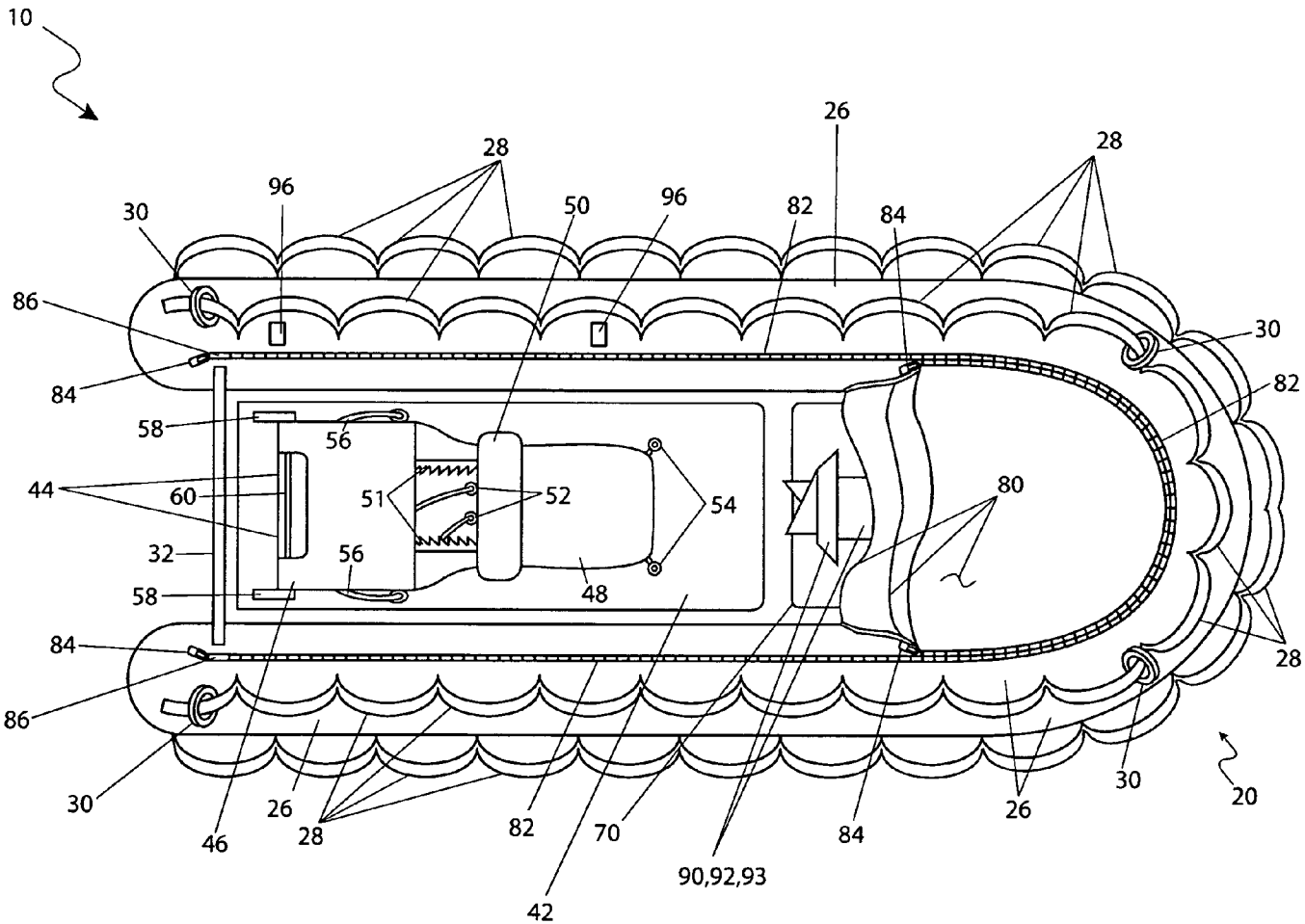
FIG. 7 is a top view of the collapsible amphibious hunting blind 10 depicting the top cover 80 in a fully retracted state, according to the preferred embodiment.

The seat assembly 40 further includes the stern board 42, a seat back 46, the head rest 50, a pair of first hammock connectors 52, a pair of guy wires 56, a pair of seat back latches 58, and an axle 60. The seat back 46 includes a rigid angularly-adjustable flat panel made of plastic, wood, or other light-weight materials, being pivotally attached along a bottom edge portion to the stern board 42 by a horizontal axle 60 inserted therethrough and being in mechanical communication with the seat back 46 and the stern board 42. The top portion of the seat back 46 provides an adjustable cushioned textile head rest 50 having a pair of integrated height-adjustable rod mechanisms 51 being similar to those found in automotive head rest applications, as seen in FIG. 7. The seat back 46 is securely positioned at a slight rearward angle by a forwardly extending guy wire 56 allowing the seat back 46 to pivot rearwardly to an angle defined by a length of the guy wire 56. The guy wires 56 are envisioned to be made of stainless wire cord or rope and are located along each side area of the seat back 46 being affixed to the seat back 46 and the stern board 42 using cable attachment hardware. Furthermore, the seat back 46 is selectively restrained from pivoting forwardly by a pair of manually releasable seat back latches 58. The latches 58 are envisioned to be made of similar materials as the seat back 46 and are located along lower side surfaces of the seat back 46 and provide a sturdy hooking connection between the seat back 46 and the stern board 42. Each seat back latch 58 includes an "S"-shaped handle portion being rotatably and axially attached to the seat back portion 46. The seat back latch 58 includes an integral bottom hooking feature providing a locking mechanical engagement with the stern board 42.

The stern board 42 includes a rigid injection-molded plastic structure further including a pair of wheel assemblies 44 connected to a bottom surface of the floor panel 27 and affixed to the stern board 42. The wheel assemblies 44 are positioned along outer side edges along a bottom surface arranged in a parallel manner. The wheel assemblies 44 provide easy rolling transportation of the apparatus 10 across a ground surface when in an inflated state. The wheel assemblies 44 are envisioned being made using corrosion-resistant plastic components including attached cylindrical wheel members attached by a wheel axle 45 as seen in FIG. 7.

Figure 9:
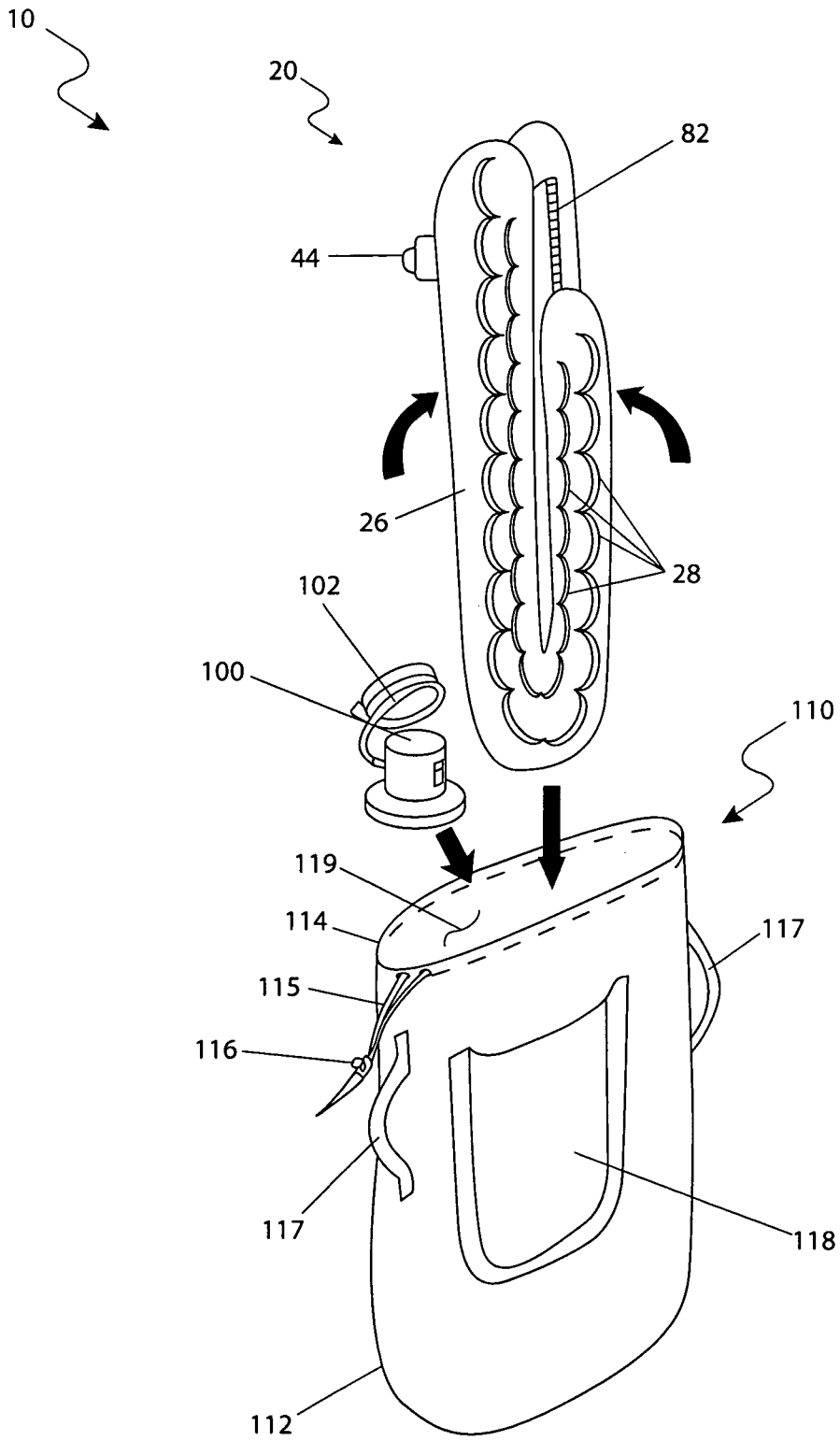

The apparatus 10 further includes a bow board 70 including similar materials and construction as the stern board 42. The bow board 70 includes a half-oval shape being positioned slightly forward of the stern board 42 and occupying a forward portion of the flotation assembly 20, thereby providing a surface onto which a user 130 may rest his or her feet as seen in FIG. 3*a*. A gap of approximately four (4) inches exists between the stern board 42 and the bow board 70, which allows the apparatus 10 to be deflated and folded in half for compact storage as shown in FIG. 9. The stern board 42 and bow board 70 are permanently bonded to the subjacent floor panel 27 using industrial marine adhesives to form a substantial floor area within the flotation assembly 20.

The apparatus 10 further includes a canopy assembly 90 further including a plurality of camouflaged mesh side panels 92, a mesh roof panel 93, a sewn-in multi-element canopy frame 94, and a pair of canopy fasteners 96. The canopy assembly 90 includes a one-piece textile sheet having mesh side panel portions 92 which are affixed along an upper edge to the mesh roof panel 93. Adjacent mesh side panels 92 are joined by respective sewn-in second zippers 95 to form a polyhedron-shaped roof structure suitable to contain and conceal the user's 130 head and upper torso. The shape of the canopy assembly 90 is held taut by individual elements of the sewn-in canopy frame 94 being positioned along all edge areas. The canopy frame 94 members are envisioned to include entrapped flexible fiberglass rods similar to those used in dome tent construction. The canopy assembly 90 is removably attached to the flotation assembly 20 along a single side edge by at least two (2) canopy fasteners 96 which include hook-and-loop fastener strips sewn onto a lower edge of a mesh side panel 92 and in an aligned and corresponding position along a top portion of the bladder cover 26. The canopy fasteners 96 allow the canopy assembly 90 to be motioned upward and sideways, being pivoted about the canopy fasteners 96, thereby allowing the user 130 to enter and exit the apparatus 10 as well as shoot from the apparatus 10 as shown in FIGS. 1 and 5. The mesh panels 92, 93 are envisioned to be made of a fabric material having a high percentage of open area to provide ventilation and visibility, and are to be painted externally with various popular camouflage patterns to conceal the presence of the user 130 inside.

Referring now to FIG. 5, a transparent view of the apparatus 10 depicting the shooting state, is disclosed. The canopy assembly 90 is illustrated here in an outwardly pivoted position allowing the user 130 to sit up and shoot the rifle 140.

The bladder 22 further includes an integrated air fill valve 34 located along an inner surface of the flotation assembly 20 which includes a removably plugged conduit port which provides a way to inflate and deflate the bladder 22. Furthermore, the apparatus 10 is envisioned to be introduced having an external, commercially available portable battery-powered air pump 100, shown here for illustration sake. The air pump 100 provides compressed air to inflate the bladder 22 through the fill valve 34. The air pump 100 is envisioned to provide expected features and equipment such as, but not limited to: a flexible hose 102, a tapered or threaded hose adapter 103, and an ON/OFF switch 104.

Figure 6:
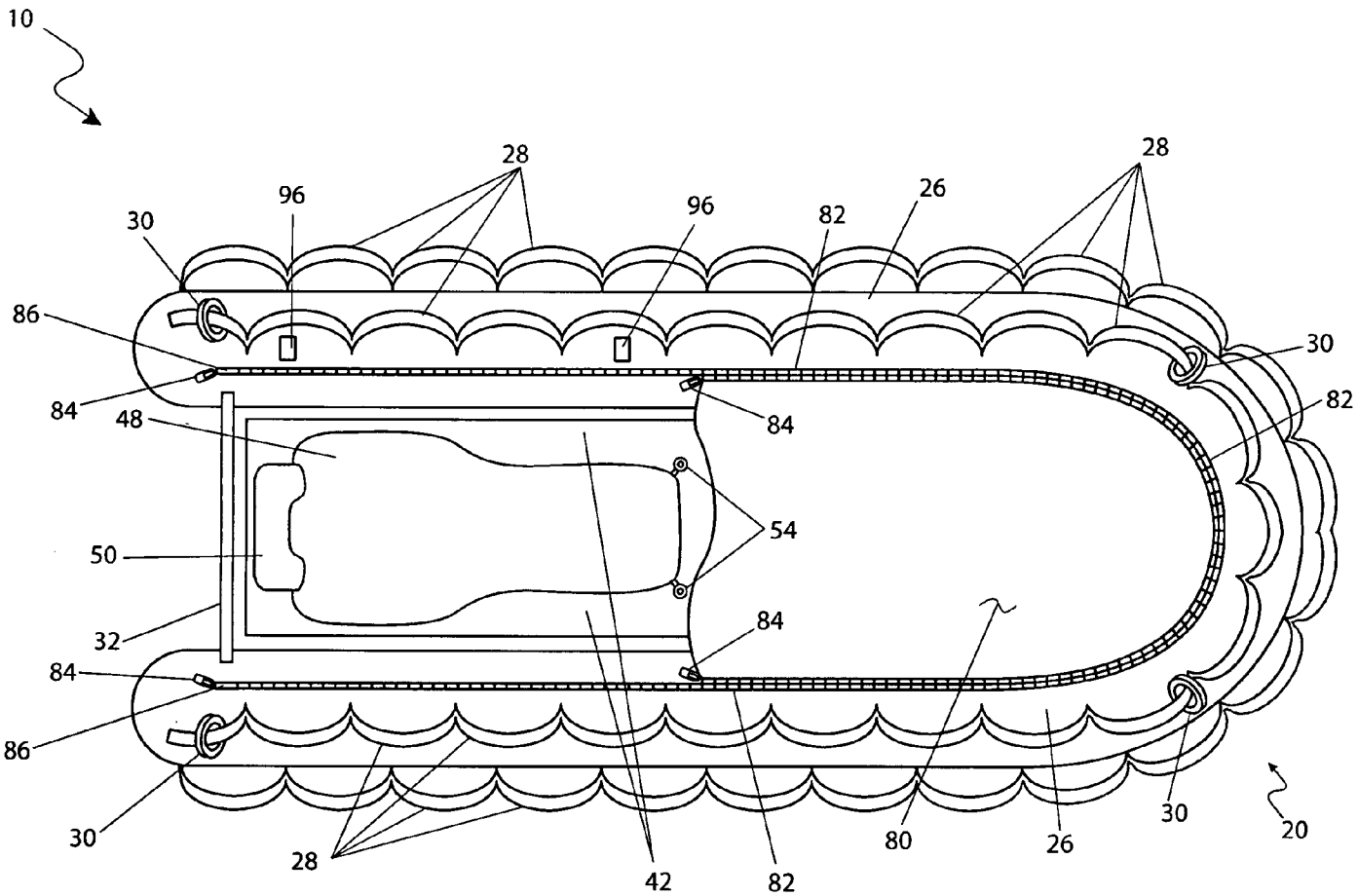
FIG. 6 is a top view of the collapsible amphibious hunting blind 10 depicting a top cover 80 in a partially retracted state, according to the preferred.
Figure 8:
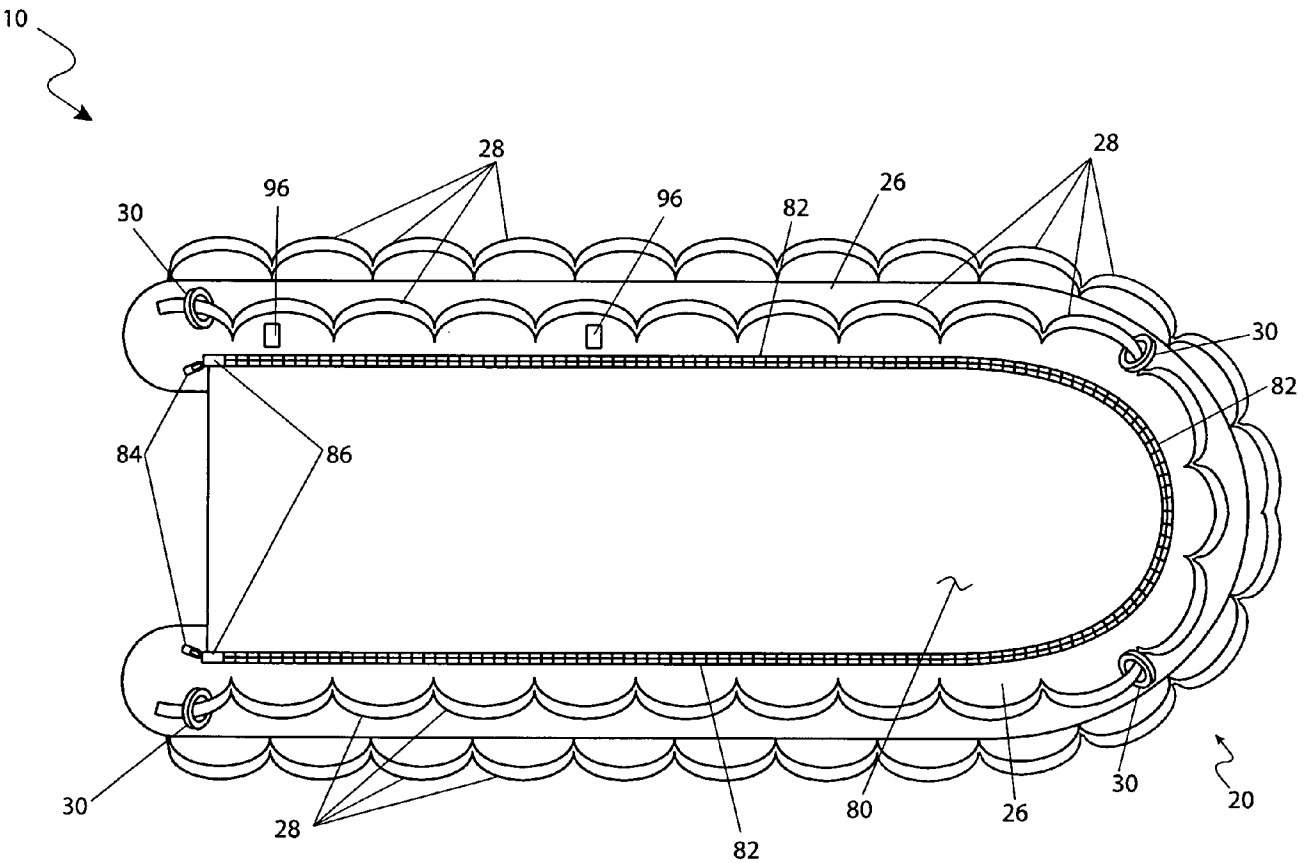
FIG. 8 is a top view of the collapsible amphibious hunting blind 10 depicting the top cover 80 in a fully closed state, according to the preferred embodiment; and, FIG. 9 is a perspective view of a carrying bag 110 of the collapsible amphibious hunting blind 10, according to the preferred embodiment.

Referring now to FIGS. 6, 7, and 8, various top views of the top cover 80 depicting various states of deploy, are disclosed. The textile top cover 80 is affixed all around a top surface of the flotation assembly 20 by the first zipper 82. The first zipper 82 is envisioned to include a heavy-duty corrosion-resistant brass or plastic zipper assembly sewn into respective opposing portions of the flotation assembly 20 and the top cover 80. The first zipper 82 includes expected components such as a pair of dual-directional zipper pullers 84 and a pair of zipper stops 86 being positioned at an open end portion of the flotation assembly 20. The first zipper 82 and top cover 80 are envisioned to be unzipped and retracted to an intermediate position as shown in FIG. 6, when used in conjunction with the canopy assembly 90 during hunting or observation, as shown in FIG. 3*a*. In a like manner, the first zipper 82 and top cover 80 may be completely opened, as shown in FIG. 7, to facilitate collapsing the seat assembly 40 against the floor panel 27, storage of the canopy assembly 90, and loading of any other equipment, as desired, into the flotation assembly 20 for storage purposes. Finally, the first zipper 82 may be completely zipped to enclose the aforementioned portions and equipment under the top cover 80 for storage in a carrying bag assembly 110 as shown in FIG. 9.

Referring now to FIG. 9, a perspective view of the apparatus 10 depicting use of the carrying bag 110, is disclosed. The apparatus 10 can be prepared for compact storage by deflating the fill valve 34 and folding the floatation assembly 20 in half along an area of the floor panel 27 between the stern board 42 and the bow board 70. The carrying bag 110 provides a convenient way to package, store, and transport the flotation assembly 20, the canopy assembly 90, and the air pump 100 when not being used. The carrying bag 110 includes a rugged open-ended textile bag body 112 further including a sewn-in, cinching-type closure 114 at an end portion which utilizes a cinch cord 115 integrated into an open perimeter edge having a push-button, cord locking fitting 116 to maintain the carrying bag 110 in a closed state. The carrying bag 110 further includes a pair of opposing sewn-on textile handles 117 which provide for two-handed or two-person carrying and a large textile pouch 118 sewn onto a front surface of the bag body 112 to provide additional storage of miscellaneous items associated with use of the apparatus 10.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the apparatus 10, it would be assembled and utilized as indicated in FIGS. 1 and 2.

The method of assembling and utilizing the apparatus 10 may be achieved by performing the following steps: procuring a desired model of the apparatus 10 having a specific desired color and pattern suitable for an anticipated usage; transporting the apparatus 10 to a body of water 120 using the carrying bag assembly 110 and integral handle portions 117; removing the air pump 100 and flotation assembly 20 from the carrying bag assembly 110 by loosening the cinch cord 115 and removing the portions; unfolding the flotation assembly 20 upon a flat surface in proximity to a body of water 120; connecting the air pump 100 to the fill valve 34 using the hose adapter 103; initiating a flow of compressed air into the bladder portion 22 of the flotation assembly 20 by pressing the ON/OFF switch portion 104 of the air pump 100 to an "ON" position; allowing a period of time for the bladder 22 to achieve a desired internal air pressure; turning off the air pump 100 using the ON/OFF switch 104; plugging the fill valve 34 in a conventional manner; transporting the inflated apparatus 10 to a body of water 120 by lifting an end of the flotation assembly 20 and pushing or pulling the apparatus 10 smoothly along a ground surface upon the wheel assemblies 44; unzipping the first zipper 82 to retract the top cover 80; removing the collapsed canopy assembly 90 from the floor panel portion 27 of the flotation assembly 20; assembling the canopy assembly 90 by zipping the second zippers 95, thereby erecting the canopy assembly 90 into a taut polyhedron structure; affixing the canopy assembly 90 to the flotation assembly 20 by attaching corresponding canopy fasteners 96 integral to the canopy assembly 90 and the flotation assembly 20; pivoting the canopy assembly 90 upwardly to a side position; pivoting the seat back portion 46 of the seat assembly 40 upwardly until the guy wires 56 are taut; locking the seat back 46 in an upright position by manually engaging the seat back latches 58 with the stern board 42; pushing the apparatus 10 onto a body of water 120 while the user 130 coincidentally enters the flotation assembly 20; positioning the user 130 in a reclined sitting position upon the hammock 48; motioning the apparatus 10 across the body of water 120 to a desired destination using a paddle, an oar, or similar device; securing the apparatus 10 to foliage, a tree, or other appendage, as desired, using the rings 30; securing the top cover 80 to a desired deployed position by utilizing the puller portions 84 of the first zipper 82; pulling the canopy assembly 90 up over the user 130 until the canopy 90 is resting on upper surfaces of the flotation assembly 20; waiting for a period of time until sighting game or water fowl; pivoting the canopy assembly 90 away in an upward and sideways direction; sitting upwardly and positioning a rifle 140 for shooting the game or water fowl; repeating the waiting and shooting steps as desired until completing a hunting activity; motioning the apparatus 10 to a shoreline portion of the body of water 120; pulling the apparatus 10 onto a ground surface using the wheels 44 as previously described; preparing the apparatus 10 for storage by deflating the bladder 22 using the fill valve 34 until flattened; collapsing the seat back 46 downwardly using the seat back latches 58; collapsing the canopy assembly 90 to a flat form by unzipping the second zippers 95 and folding inwardly; storing the collapsed canopy assembly 90 upon the floor panel portion 27; securing the canopy assembly 90 and any other desired contents within the flotation assembly 20 by closing the top cover 80 using the first zippers 82; folding the flotation assembly 20 in half along a portion of the floor panel 27 between the stern 42 and bow 70 boards; inserting the apparatus 10 into the closure portion 114 of the carrying bag assembly 110; closing the carrying bag assembly 110 using the cinch cord 115 and cord locking fitting 116; transporting and storing the apparatus 10 until again needed; and, benefiting from a light-weight and portable personal floating hunting enclosure afforded the user 130 of the present invention 10.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

What is claimed is:

1. A collapsible amphibious hunting blind comprising:

a buoyant flotation assembly having an inflatable bladder with a bow end and a stern end and a flexible floor panel extending between lower interior sidewalls of said bladder;

a rigid stern board affixed to a stern end of an upper surface of said floor panel;

a rigid bow board affixed to a bow end of said upper surface of said floor panel;

a canopy assembly removably attached to said stern end of a top of said bladder for generally covering said stern end of said floor panel, comprising:

a rectangular mesh roof panel; and, four trapezoidal mesh side panels affixed along an upper longitudinal edge to a peripheral edge of said mesh roof panel; and, a seat assembly pivotably connected to said stern board;

wherein said mesh roof panel and said mesh side panels each further comprise a rigid canopy frame affixed to said peripheral edges for structural support;

wherein each of said mesh side panels are releasably fastened together along adjacent side edges; and, wherein said seat assembly provides support for an occupant in a generally supine position.

2. The blind of claim 1, further comprising a top cover releasably fastened between upper interior sidewalls of said bladder from said bow end to said stern end for generally covering said bow end.

3. The blind of claim 2, wherein said top cover is releasably fastened between said upper interior sidewalls of said bladder by a length of zipper tape affixed to a peripheral edge of said top cover and a corresponding length of zipper tape affixed to said upper interior sidewalls of said bladder.

4. The blind of claim 1, wherein said bladder further comprises a flexible and durable bladder cover that completely surrounds said bladder.

5. The blind of claim 4, further comprising a plurality of flexible loops affixed to an exterior of said bladder cover along a longitudinal axis of said bladder for removably receiving camouflaging material.

6. The blind of claim 1, wherein said seat assembly further comprises:

a rigid generally flat seat back hingedly connected to a rearward end of said stern board;

a hammock extending between an upper end of said seat back and a forward end of said stern board;

a cushioned height adjustable head rest extendably connected to said upper end of said seat back;

a pair of guy wires extending between longitudinal sides of said seat back and said stern board for limiting rearward motion when in an upright position;

at least one seat back latch affixed between a lower end of said seat back and said stern board for releasably securing in said generally upright position.

7. The blind of claim 1, further comprising a pair of wheel assemblies mounted to said stern end of a bottom surface of said floor panel and affixed to said stern board.

8. The blind of claim 1, wherein said bladder further comprises a generally U-shape having a longitudinal axis;

wherein each leg of said U-shape is substantially parallel to said longitudinal axis; and, wherein said floor panel curves upwardly on said stern end between said legs of said U-shape defining a rear panel.

9. The blind of claim 1, wherein said flotation assembly is foldable about a flexible area between said stern board and said bow board when said bladder is deflated for placing said blind in a collapsed state.

10. The blind of claim 9, further comprising a carrying bag for removably receiving said blind when deflated and folded into said collapsed state, said bag further comprising a durable shell having a closed bottom, an open top, and sidewalls defining an interior portion and at least one carrying handle.

11. A collapsible amphibious hunting blind comprising:

a buoyant inflatable bladder having a bow end and a stern end and comprising a generally U-shape having a longitudinal axis, wherein each leg of said U-shape is substantially parallel to said longitudinal axis;

a flexible floor panel extending between lower interior sidewalls of said bladder, wherein said floor panel curves upwardly on a stern end between said legs of said U-shape defining a rear panel;

a flexible and durable bladder cover that completely surrounds said bladder;

a rigid stern board affixed to a stern end of an upper surface of said floor panel;

a rigid bow board affixed to a bow end of said upper surface of said floor panel;

a seat assembly pivotably connected to said stern board, wherein said seat assembly provides support for an occupant in a generally supine position;

a canopy assembly removably attached to said stern end of a top of said bladder for generally covering said stern end; and, a top cover releasably fastened between upper interior sidewalls of said bladder from said bow end to said stern end for generally covering said bow end;

wherein said blind is foldable about a flexible area between said stern board and said bow board when said bladder is deflated for placing said blind in a collapsed state.

12. The blind of claim 11, wherein said seat assembly further comprises:

a rigid generally flat seat back hingedly connected to a rearward end of said stern board;

a hammock extending between an upper end of said seat back and a forward end of said stern board;

a cushioned height adjustable head rest extendably connected to said upper end of said seat back;

a pair of guy wires extending between longitudinal sides of said seat back and said stern board for limiting rearward motion when in an upright position;

at least one seat back latch affixed between a lower end of said seat back and said stern board for releasably securing in said generally upright position.

13. The blind of claim 12, wherein said canopy assembly further comprises:

a rectangular mesh roof panel;

four trapezoidal mesh side panels affixed along an upper longitudinal edge to a peripheral edge of said mesh roof panel; and, wherein said mesh roof panel and said mesh side panels each further comprise a rigid canopy frame affixed to said peripheral edges for structural support; and, wherein each of said mesh side panels are releasably fastened together along adjacent side edges.

14. The blind of claim 13, wherein said top cover is releasably fastened between said upper interior sidewalls of said bladder by a length of zipper tape affixed to a peripheral edge of said top cover and a corresponding length of zipper tape affixed to said upper interior sidewalls of said bladder cover.

15. The blind of claim 14, further comprising a plurality of flexible loops affixed to an exterior of said bladder cover along a longitudinal axis of said bladder for removably receiving camouflaging material.

16. The blind of claim 15, further comprising a pair of wheel assemblies mounted to of a bottom surface of said floor panel and affixed to said stern board at said stern end.

17. The blind of claim 16, further comprising a carrying bag for removably receiving said blind when deflated and folded into said collapsed state, said bag further comprising a durable shell having a closed bottom, an open top, and sidewalls defining an interior portion and at least one carrying handle.

18. A method of concealing oneself on a surface of a body of water using a collapsible amphibious hunting blind, comprising the steps of:

providing a collapsible amphibious hunting blind comprising a buoyant inflatable bladder having and bow end and a stern end and comprising a generally U-shape having a longitudinal axis, wherein each leg of said U-shape is substantially parallel to said longitudinal axis, a flexible floor panel extending between lower interior sidewalls of said bladder, wherein said floor panel curves upwardly on a stern end between said legs of said U-shape defining a rear panel, a flexible and durable bladder cover that completely surrounds said bladder, a rigid stern board affixed to a stern end of an upper surface of said floor panel, a rigid bow board affixed to a bow end of said upper surface of said floor panel, a rigid generally flat seat back hingedly connected to a rearward end of said stern board, a hammock extending between an upper end of said seat back and a forward end of said stern board, a cushioned height adjustable head rest extendably connected to said upper end of said seat back, a pair of guy wires extending between longitudinal sides of said seat back and said stern board, at least one seat back latch affixed between a lower end of said seat back and said stern board, a canopy assembly removably attached to said stern end of a top of said bladder comprising a rectangular mesh roof panel, four trapezoidal mesh side panels affixed along an upper longitudinal edge to a peripheral edge of said mesh roof panel, rigid canopy frame affixed to said peripheral edges said mesh roof panel and said mesh side panels each further comprise a for structural support, wherein each of said mesh side panels are releasably fastened together along adjacent side edges, a top cover releasably fastened between upper interior sidewalls of said bladder from said bow end to said stern end, and a plurality of flexible loops affixed to an exterior of said bladder cover along a longitudinal axis of said bladder;

transporting said blind to said body of water;

inflating said bladder;

retracting said top cover;

assembling said canopy assembly by fastening said adjacent sides to erect a taut polyhedron structure;

attaching said canopy assembly to said bladder cover;

pivoting said canopy assembly upwardly to a side position;

pivoting said seat back upwardly until said guy wires are taut;

locking said seat back in a generally upright position;

placing said blind onto said body of water;

occupying said blind in a generally supine position upon said hammock;

moving said blind across said body of water to a desired destination;

fastening said top cover to a desired deployed position to conceal a lower portion of an occupant;

pivoting said canopy assembly up over until resting on upper surfaces of said bladder to conceal an upper portion of said occupant;

waiting until sighting game or water fowl;

pivoting said canopy assembly away in an upward and sideways direction to reveal said occupant; and, sitting upward to a suitable position for firing a firearm.

* * * * *